US007796674B2

(12) United States Patent
Keough

(10) Patent No.: US 7,796,674 B2
(45) Date of Patent: Sep. 14, 2010

(54) COLD CRUCIBLE INDUCTION FURNACE

(75) Inventor: Graham A. Keough, Hainesport, NJ (US)

(73) Assignee: Consarc Corporation, Rancocas, NJ (US)

( * ) Notice: Subject to any disclaimer, the term of this patent is extended or adjusted under 35 U.S.C. 154(b) by 0 days.

(21) Appl. No.: 11/035,992

(22) Filed: Jan. 14, 2005

(65) Prior Publication Data

US 2005/0175064 A1 Aug. 11, 2005

Related U.S. Application Data

(60) Provisional application No. 60/537,113, filed on Jan. 16, 2004.

(51) Int. Cl.
*H05B 6/22* (2006.01)
*H05B 6/02* (2006.01)

(52) U.S. Cl. ..... 373/151; 373/147; 373/142; 373/157

(58) Field of Classification Search ..... 373/151, 373/147, 148, 146, 150, 152, 156, 142, 145, 373/155, 140, 76, 133, 157, 158
See application file for complete search history.

(56) References Cited

U.S. PATENT DOCUMENTS

| | | | | | |
|---|---|---|---|---|---|
| 2,448,012 | A | * | 8/1948 | Baker | 219/645 |
| 3,461,215 | A | * | 8/1969 | Reboux | 373/158 |
| 4,901,169 | A | | 2/1990 | Hamaoka et al. | |
| 4,923,508 | A | | 5/1990 | Diehm et al. | |
| 5,058,127 | A | * | 10/1991 | Garnier et al. | 373/157 |
| 5,109,389 | A | * | 4/1992 | Stenzel | 373/156 |
| 5,257,281 | A | | 10/1993 | Cignetti et al. | |
| 5,901,169 | A | * | 5/1999 | Kobayashi | 373/142 |

* cited by examiner

*Primary Examiner*—Quang T Van
(74) *Attorney, Agent, or Firm*—Philip O. Post

(57) ABSTRACT

A cold crucible induction furnace has a slotted-wall with a slotted inner annular protrusion that is disposed around the base of the crucible's melting chamber. The protrusions may be separated from the base by a gap that can be filled with an electrical insulating material. Slots may also be provided in the protrusions and/or the outer perimeter of the base.

22 Claims, 9 Drawing Sheets

COLD CRUCIBLE INDUCTION FURNACE

CROSS REFERENCE TO RELATED APPLICATIONS

This application claims the benefit of U.S. Provisional Application No. 60/537,113 filed Jan. 16, 2004, hereby incorporated herein by reference in its entirety.

FIELD OF THE INVENTION

The present invention is in the technical field of melting electrically conductive materials by magnetic induction with a cold crucible induction furnace.

BACKGROUND OF THE INVENTION

A cold crucible induction furnace is used to melt electrically conductive materials placed within the crucible by applying a magnetic field to the material. A common application of such furnace is the melting of a reactive metal or alloy, such as a titanium-based composition, in a controlled atmosphere or vacuum. FIG. 1 illustrates the principle features of a conventional cold crucible furnace. Referring to the figure, crucible 100 includes slotted wall 112. The interior of wall 112 is generally cylindrical. The upper portion of the wall may be somewhat conical in shape to assist in the removal of skull as further described below. The wall is formed from a material that will not react with a metal load placed in the crucible and is fluid-cooled by conventional means. For a titanium-based load, a copper-based composition is suitable for wall 112. Slots 118 have a very small width (exaggerated for clarity in the figure), typically on the order of 10 to 12 thousandths of an inch, and are filled with a thermal conducting, but electrical insulating material, such as mica. Base 114 forms the bottom of the crucible volume that is available for the metal load. The base is typically formed from the same material as wall 112 and is also fluid-cooled by conventional means. The base is supported above bottom structural element 126 by support means 122 that may also be used as the feed and return for a cooling medium. Base 114 is raised above bottom structural element 126 and generally limits the bottom of the induction coil to be above the height of base 114. A layer of a thermal conducting, but electrical insulating material 124 (thickness exaggerated in the figure) separates the base from wall. Typically, but not by way of limitation, the distance of separation is in the range of 0.008-inch to 0.012-inch, but as noted, may be touching, or may be as large as 1/16th of an inch. Induction coil 116 surrounds the wall of the crucible and is connected to a suitable ac power supply (not shown in the figure). When the supply is energized, current flows through coil 116 and an ac magnetic flux-producing field is created. The magnetic flux induces eddy currents in wall 112, base 114 and the metal load placed in the crucible. Flux penetration into the metal load is principally through slots 118 and a thin layer of bounding wall material. Heat generated by the eddy currents in the load melts the load. A portion of the metal load adjacent to the cooled wall and base freezes to form a skull around a molten metal product that is removed from the crucible. After removal of molten metal product from the crucible, the skull is removed from the crucible and can be used as scrap feed for a later melt of the same composition. The amount of heat energy generated in the load relative to the applied electrical energy defines the approximate efficiency of the crucible. Heat generated in the wall and base represent the major losses in the process.

A disadvantage of the conventional cold crucible 100 in FIG. 1 is that the wall-base interface interferes with flux transfer to the load in the vicinity of the interface. As shown in FIG. 1, representative flux line 120 illustrates that in the vicinity of the interface, there is a substantial decrease in magnetic flux penetration into the crucible that limits heating of the load in the region of the interface. This decrease in flux effectively limits the range of metal load capacity that the furnace can efficaciously operate within. For example, the furnace shown in FIG. 1 may provide satisfactory operation when the load capacity is between full and approximately 60 percent capacity, as represented by dashed line 127. Below 60 percent capacity, the quantity of supplied energy and/or process time increases to the point that the melting process becomes extremely inefficient. Consequently, the user of the furnace is severely limited in actual capacity operating range relative to the total capacity of the crucible.

Therefore, there exists the need for apparatus and a method of induction melting with a cold crucible wherein the flux transfer to the metal load in the vicinity of the wall-base interface allows an overall increase in efficiency as well as increasing the potential range of charge capacity of metal loads that can be melted efficiently.

BRIEF SUMMARY OF THE INVENTION

In one aspect, the invention is apparatus and method for induction melting of an electrically conductive material in a cold crucible induction furnace wherein the wall is provided with slotted annular protrusions at the wall-base interface of the crucible to allow magnetic flux penetration through the slots of the protrusion.

In another aspect, the invention is a cold crucible furnace having a crucible volume formed from an at least partially slotted furnace wall and base. A plurality of protrusions separate the slotted furnace wall from the base. A gap may be provided between each of the protrusions and the base. At least one induction coil is disposed around the furnace wall. A power source provides AC current to the induction coil, which generates a magnetic field that couples with an electrically conductive material placed in the crucible volume. The protrusions between the furnace wall and base enhance the magnetic coupling between the field and the material particularly around the region of the base. Slots may also be provided in the protrusions and/or the outer perimeter of the base to further enhance the coupling between the field and the material.

Other aspects of the invention are set forth in this specification.

BRIEF DESCRIPTION OF THE DRAWINGS

For the purpose of illustrating the invention, there is shown in the drawings a form that is presently preferred; it being understood, however, that this invention is not limited to the precise arrangements and instrumentalities shown.

FIG. 4(*b*) is a side elevation of the protrusions used in one example of the cold crucible induction furnace of the present invention.

FIG. 4(*c*) is a detailed view of one slot of a slotted wall with protrusion therefrom that is used in one example of the cold crucible induction furnace of the present invention.

FIG. 5(*b*) is a graphical illustration of the reduction in ohmic losses in the wall of one typical, non-limiting, example of the cold crucible induction furnace of the present invention as the width of the protrusions is increased.

FIG. 5(*c*) is a graphical illustration of the reduction in ohmic losses in the wall of another typical, non-limiting, example of the cold crucible induction furnace of the present invention as the width of the protrusions is increased.

FIG. 5(*d*) is a graphical illustration of the improvement in overall efficiency of a cold crucible induction furnace of the present invention as the width of the protrusions is increased.

DETAILED DESCRIPTION OF THE INVENTION

Figure 2:
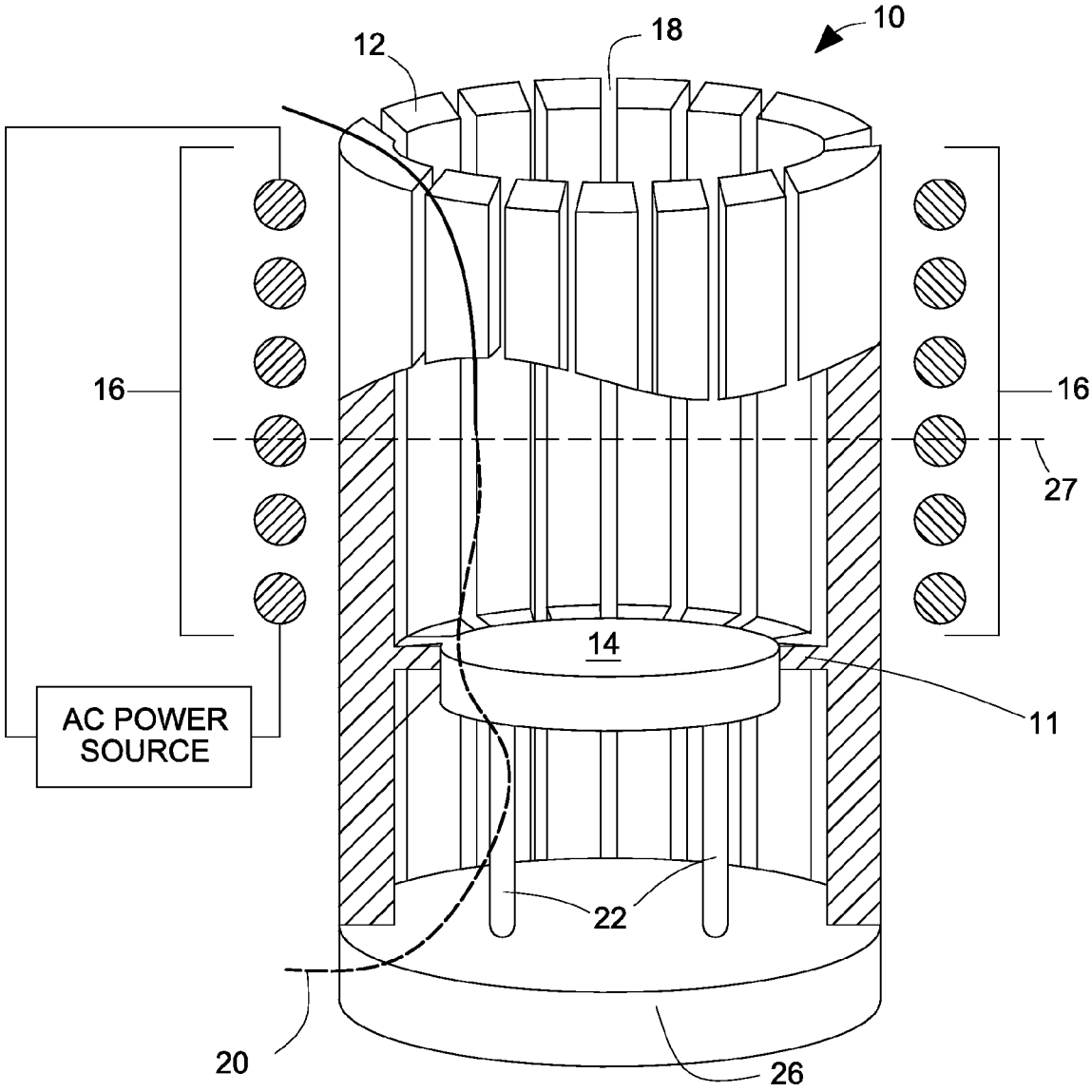
FIG. 2 is a partial cross sectional elevation of one example of the cold crucible induction furnace of the present invention.
Figure 3:
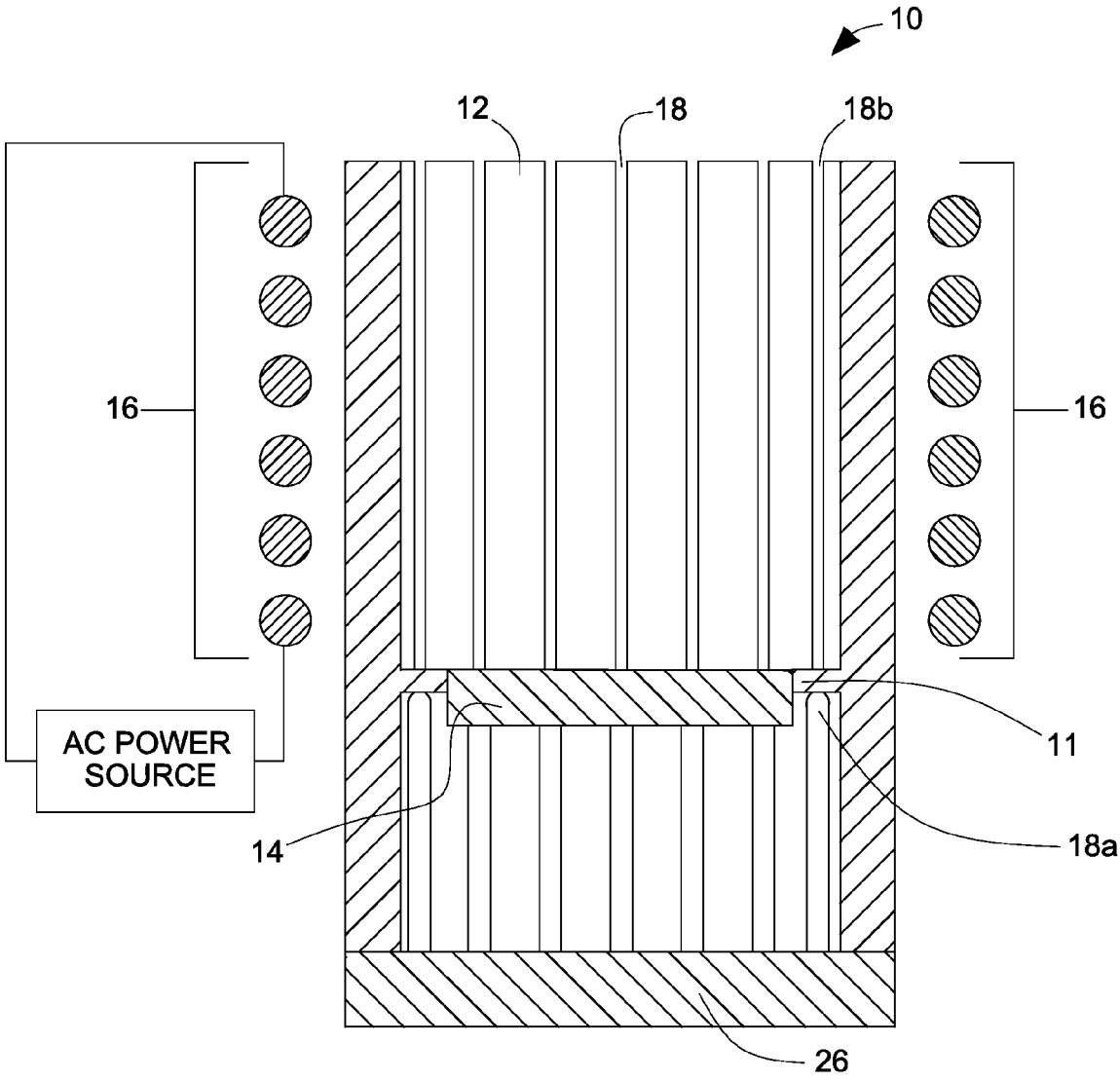
FIG. 3 is a cross sectional elevation of one example of the cold crucible induction furnace of the present invention.

There is shown in FIG. 2 and FIG. 3, one example of a cold crucible induction furnace 10 of the present invention. Furnace 10 includes wall 12 that has a plurality of protrusions 11 into the volume of the crucible adjacent to base 14. The protrusions extend around the wall's inner perimeter and may be formed either as an integral part of the wall or fitted within wall 12. Annular protrusions 11 are generally composed of the same material as wall 12. While the annular protrusions are shown with a substantially rectangular cross section, other cross sectional shapes, such as but not limited to, semicircular and semielliptical, or sloped, are within the scope of the invention. Further, although all protrusions 11 for this particular example of the invention are all of the same size and shape, protrusions of varying sizes and shapes may be used. Slots 18 are substantially continuous vertical slots through wall 12 and protrusions 11. The slots may be terminated in the wall at a distance below the top of the crucible and/or above the bottom of the crucible. However, slots are normally provided in the wall at least for the length along which molten metal will be melted and between protrusions 11.

Slots 18 have a very small width (exaggerated for clarity in the figure), typically on the order of 10 to 12 thousandths of an inch, and are filled with a thermal conducting, but electrical insulating material, such as mica. Base 14 is disposed within the perimeter of the annular protrusions 11 and forms the bottom of the crucible volume for a metal load or other electrically conductive material to be heated. Both wall 12 (including protrusions 11) and base 14 are generally fluid-cooled and formed from a material that will not react with the material to be melted in the crucible. The base is supported above bottom structural element 26 by supports 22 that may also be used as the feed and return for a cooling medium. In the present example, there is a narrow gap which separates the protrusions from the base which may or may not be filled with a thin layer of a thermal conducting, but electrical insulating material (not shown in the figures). The width of the gap typically is in the range of 0.008-inch to 0.012-inch. Alternatively, the base and protrusions may be thermally and/or electrically in contact with each other.

Figure 6:
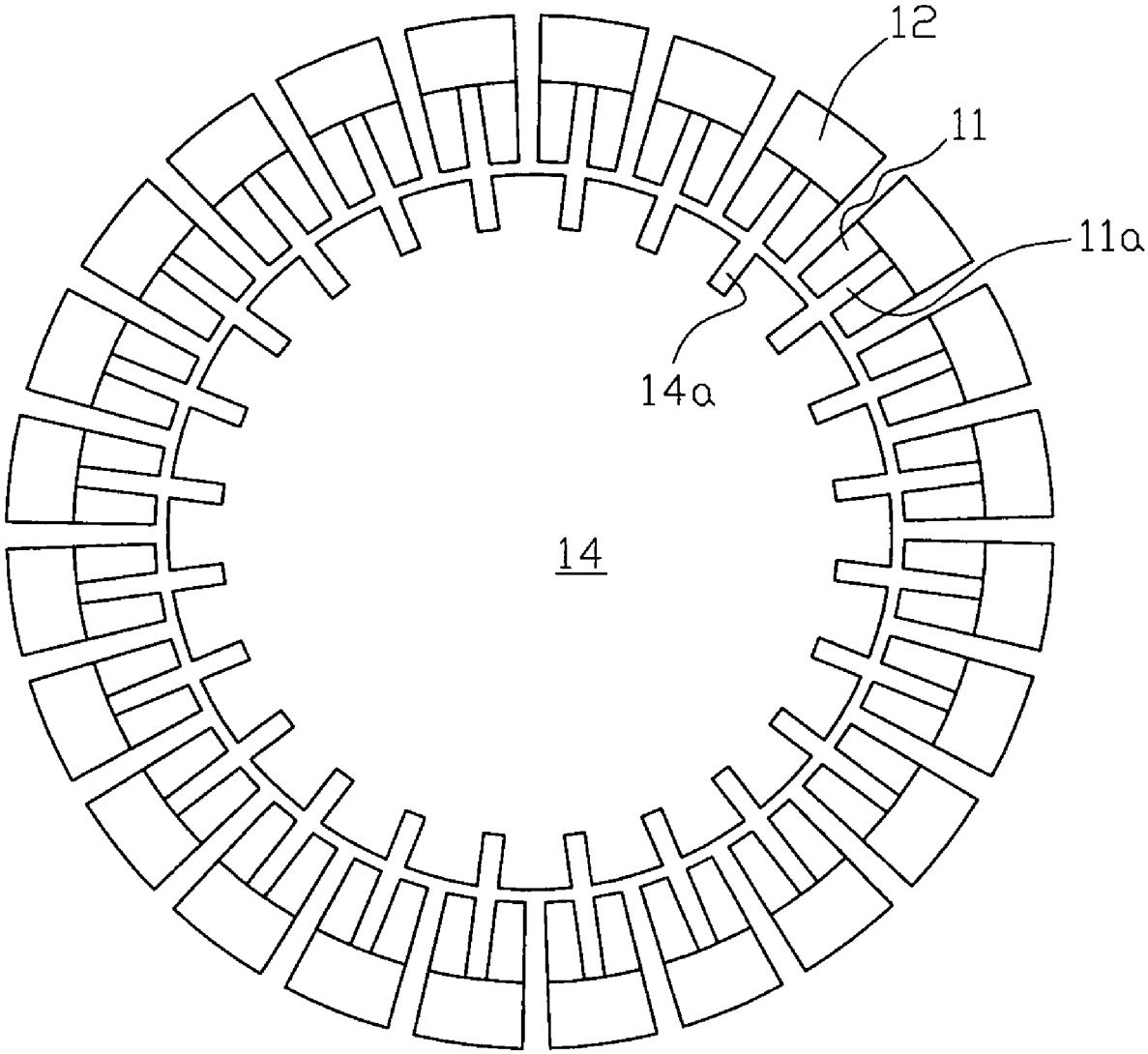
FIG. 6 illustrates one example of the cold crucible induction furnace of the present invention wherein slots are provided in the protrusions and base of the furnace.

In some examples of the invention, one or more of protrusions 11 may be slotted. That is, one or more protrusions may have protrusion slots that do not correspond to wall slots. Providing protrusion slots can for some designs provide a path for additional flux to couple to the load. Protrusion slots typically range in width according to the width of slots in the upper wall of the crucible. Additionally slots may be made in the periphery of the base either abutting the protrusions or randomly spaced about the periphery of the base. Also in some examples of the inventions, protrusion slots and slots in the periphery of the base may both be used. FIG. 6 illustrates one non-limiting example of the invention wherein protrusion slots 11*a* are provided in the protrusions and base slots 14*a* are provided in the base.

Figure 1:
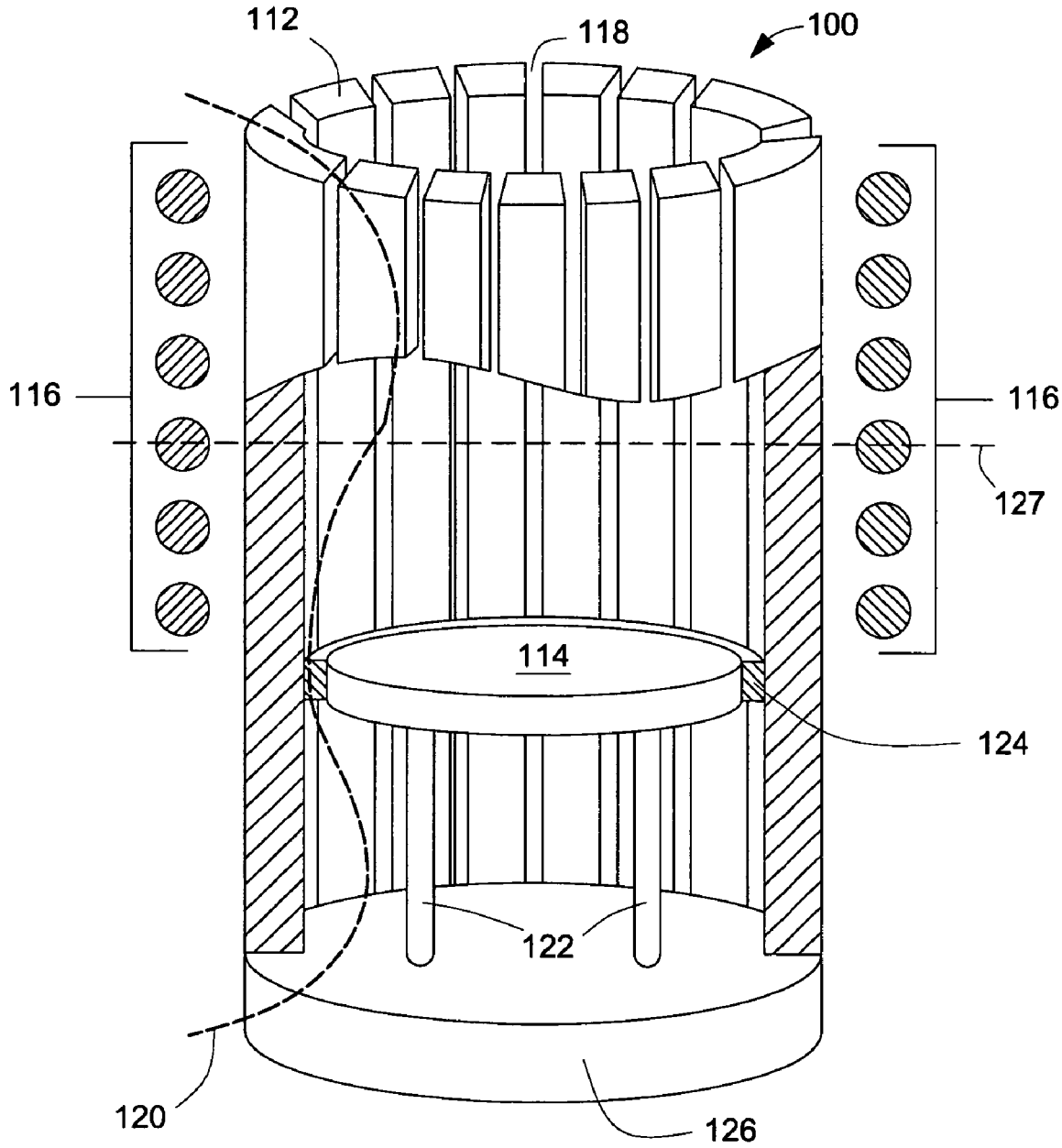
FIG. 1 PRIOR ART
FIG. 1 is a partial cross sectional elevation of a conventional cold crucible induction furnace.

The depth of eddy current penetration, which is attributed to ac current skin effect, is a function of the electrical resistivity and magnetic permeability of the metal load, and the frequency of the ac power source supplying current to induction coil 16. Approximately 63 per cent of the eddy current and 86 percent of the melting power is concentrated in what is defined as "one depth of current penetration." Therefore cold crucible 10 of the present invention typically, but not by way of limitation, provides a protrusion with a width of approximately one depth of current penetration into the metal load near the base of the crucible, which allows the crucible to be efficaciously used at higher efficiency as well as with a wider range of load capacities including smaller load capacities than achievable for the crucible in FIG. 1.

Induction coil 16 surrounds the wall of the crucible generally above base 14 and is connected to a suitable ac power supply (not shown in the figures). When the supply is energized, current flows through coil 16 and an ac magnetic flux-producing field is created. The magnetic flux induces eddy currents in wall 12, base 14 and the metal load placed in the crucible. Flux field penetration to the metal load is principally through slots 18 in the wall and between protrusions 11, and a thin layer of bounding wall material. Heat generated by the eddy currents in the load melts the load.

Figure 4A:
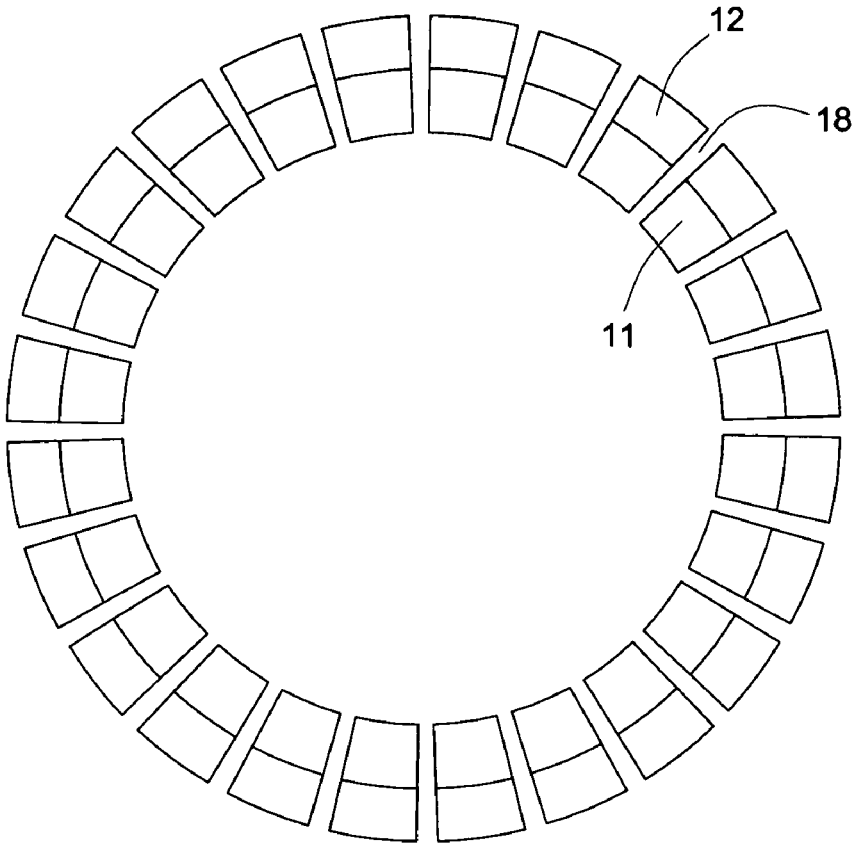
FIG. 4(*a*) is a partial top cross sectional elevation of a slotted wall with protrusions therefrom that is used in one example of the cold crucible induction furnace of the present invention.
Figure 4B:
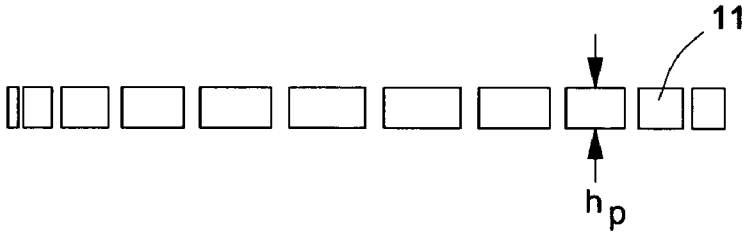
Figure 4C:
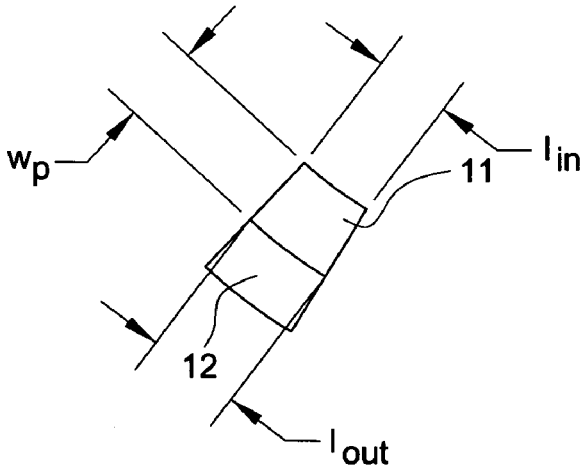
Figure 5A:
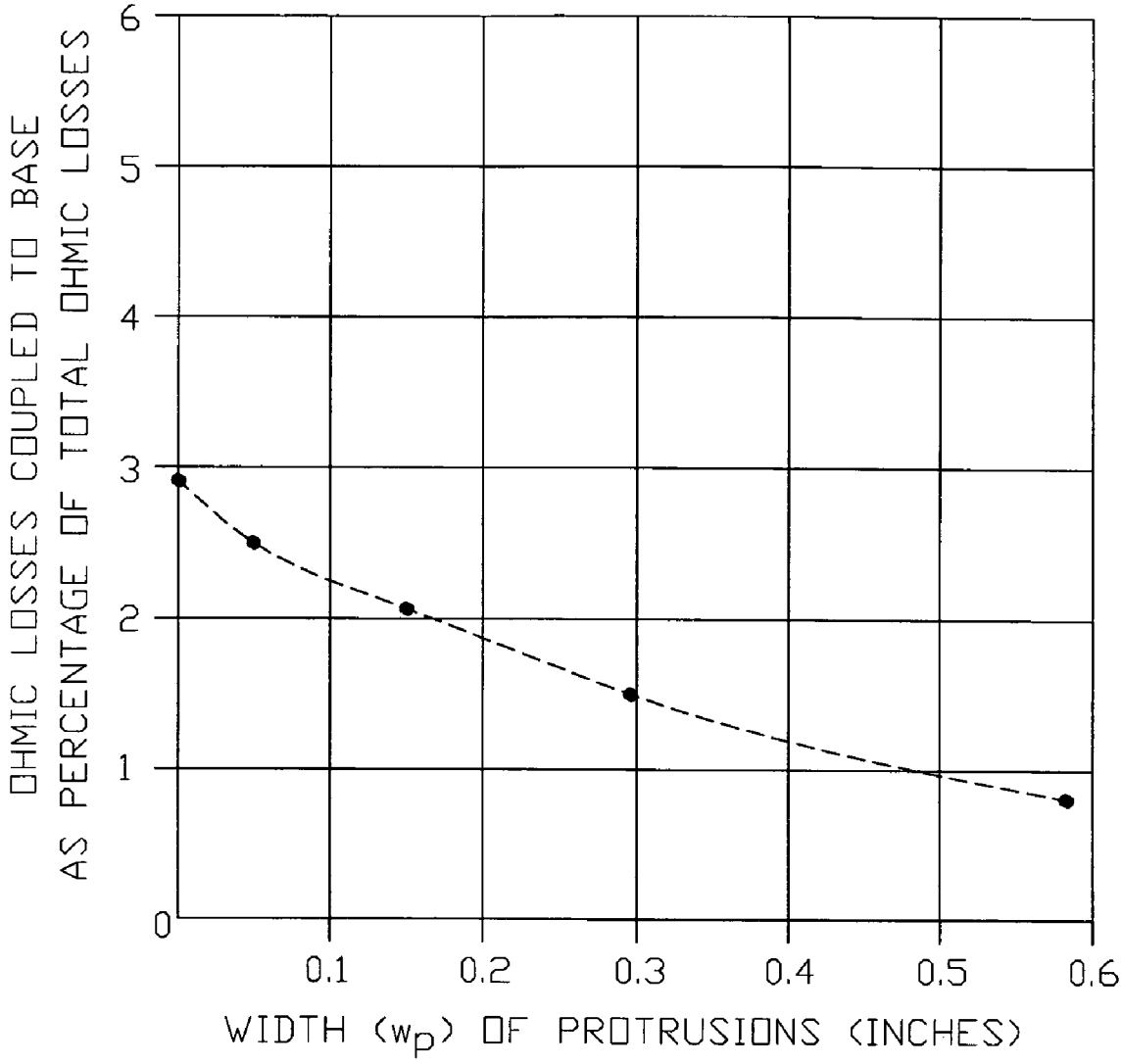
FIG. 5(*a*) is a graphical illustration of the reduction in ohmic losses in the base of one typical, non-limiting, example of the cold crucible induction furnace of the present invention as the width of the protrusions is increased.
Figure 5B:
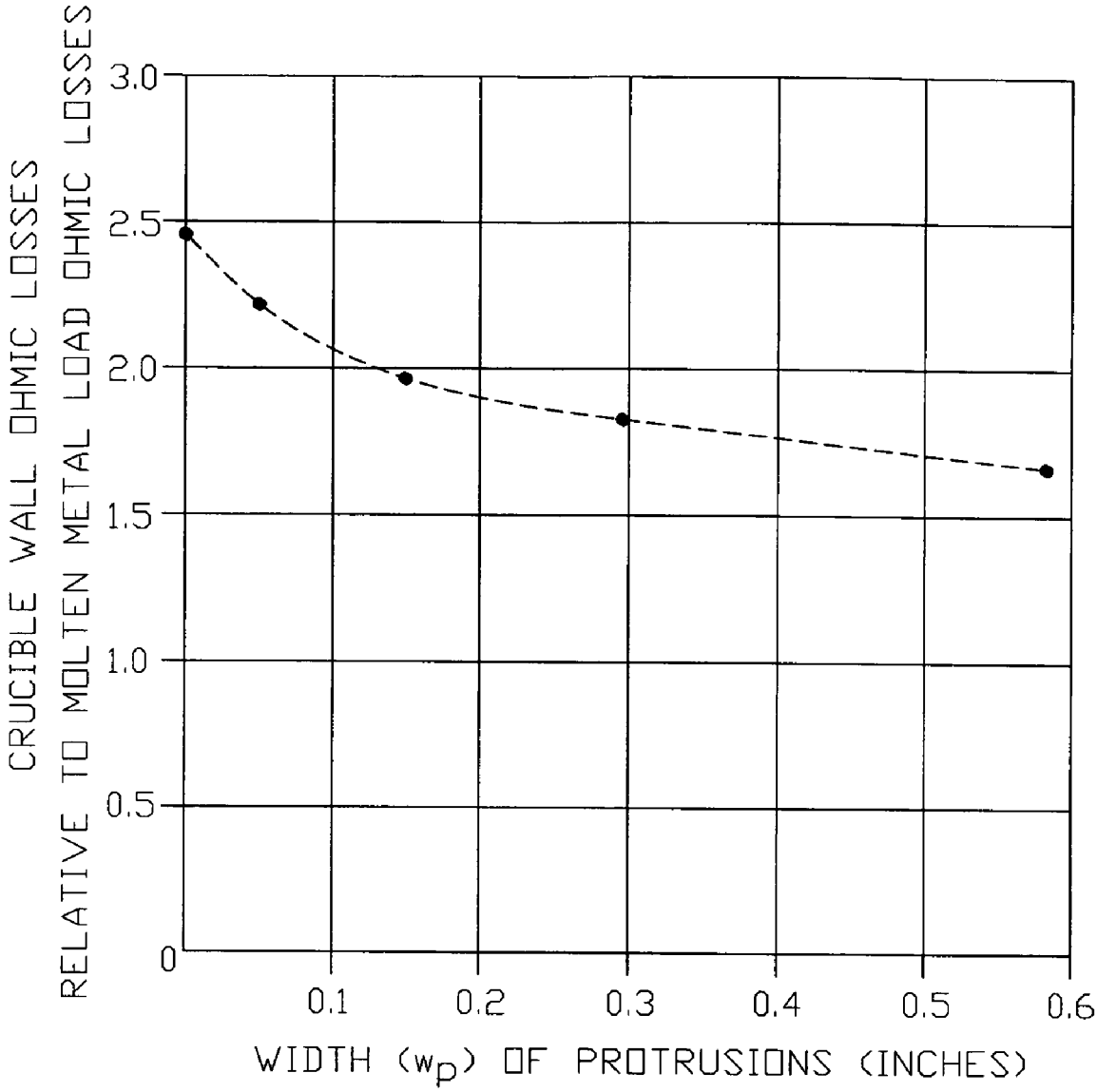
Figure 5C:
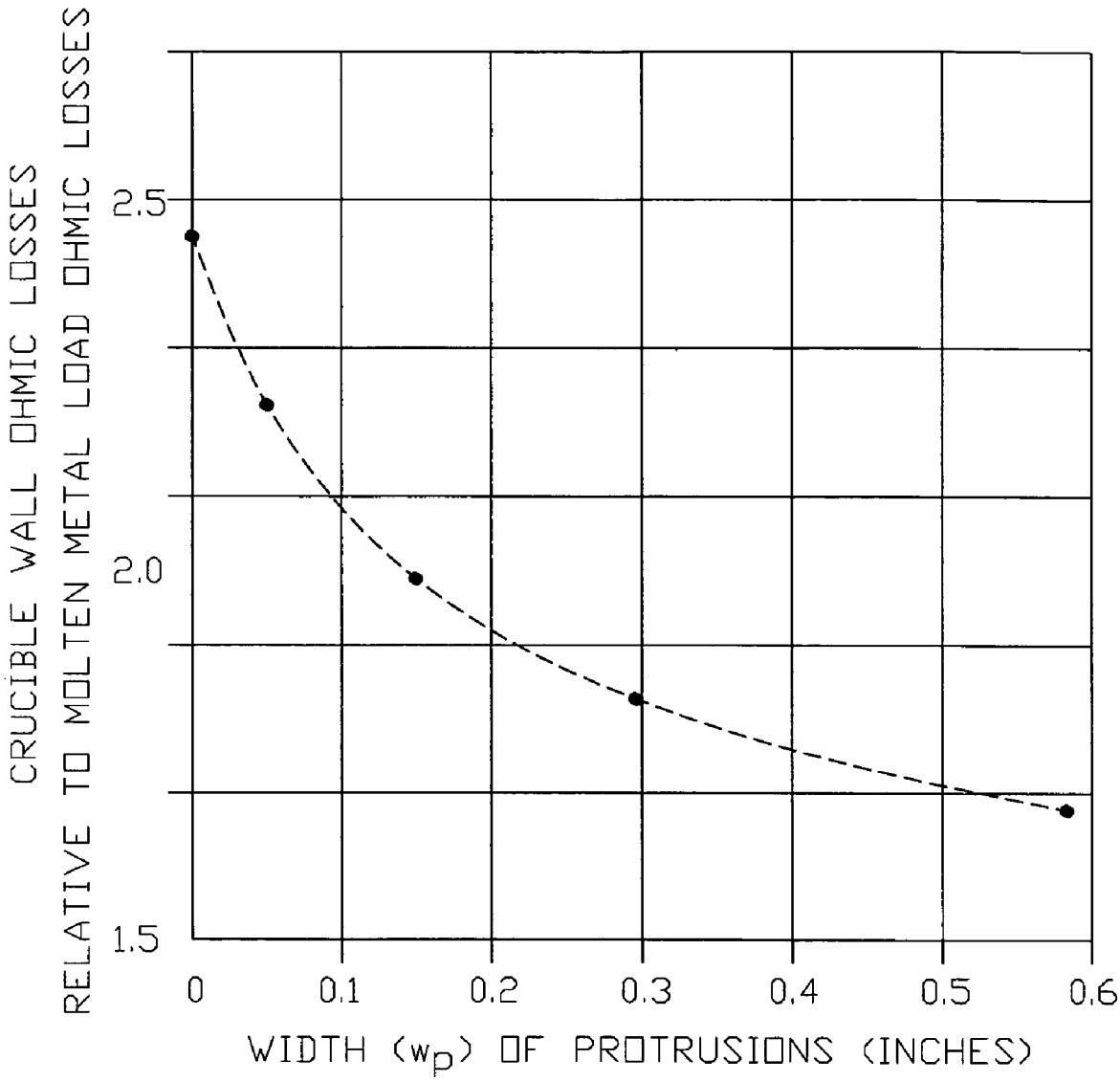
Figure 5D:
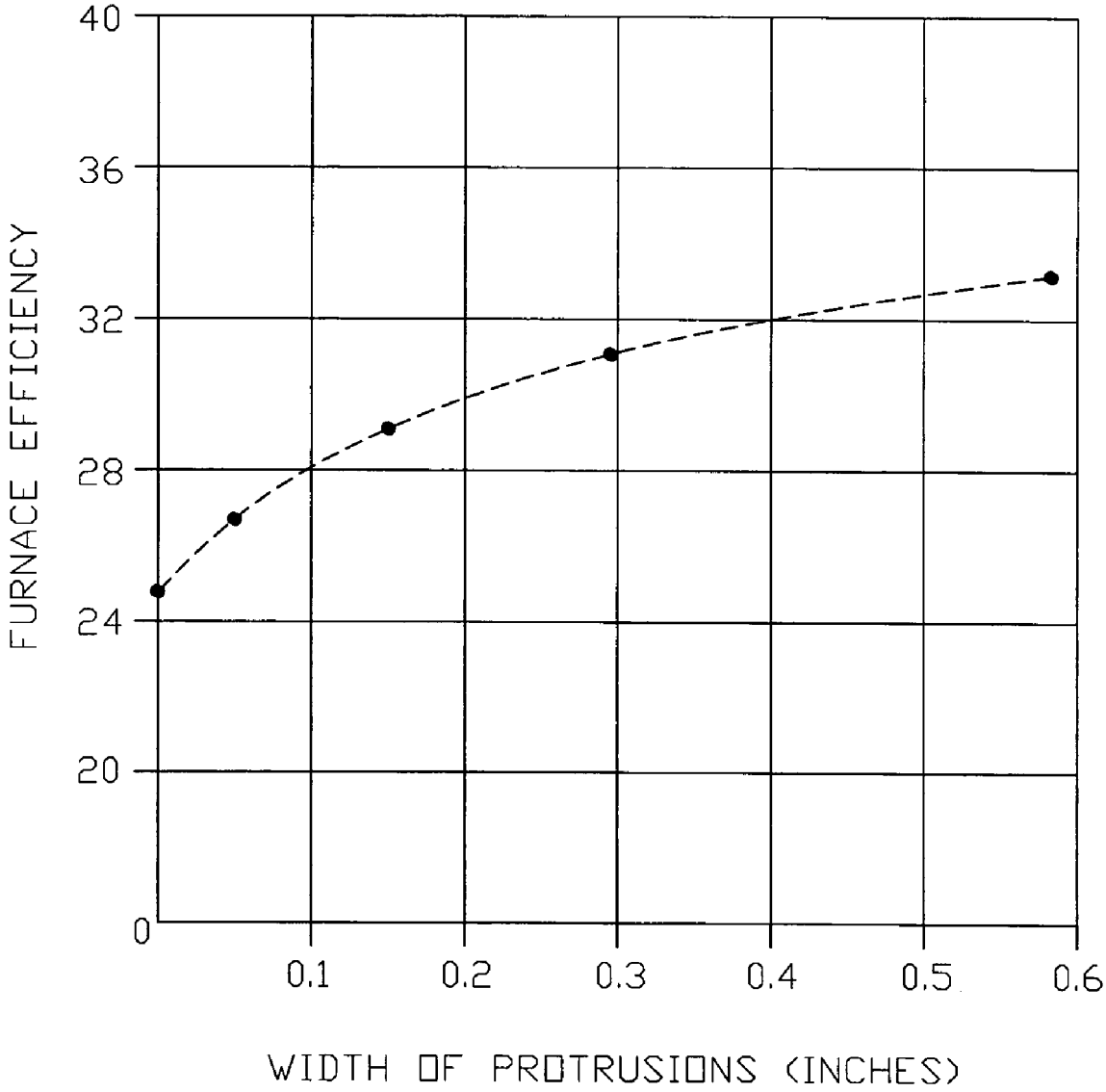

As noted above, slots 18 have a very small width. The width of the slots above base 18 should be very narrow since wider slots would allow molten metal load to melt insulation in the slots and penetrate the slots, where it freezes as skull. Skull formed with these irregular protrusions into the slots becomes extremely difficult to remove from the crucible and typically results in damage to the crucible. In another example of the present invention, the slots below base 14 may be widened as shown in FIG. 3. Widened lower partial slots 18*a*, when used with protrusions 11, allow for greater penetration of the flux field into the wall-base interface region, which enhances the total magnetic flux in the load at the wall-base interface region. Above base 14 the width of the upper partial slot is limited by the need to avoid liquid metal penetration of the slot. Below base 14 that limitation does not apply, but, the maximum width of the lower partial slot (at or below the protrusions) is effectively limited by the arrangement of the cooling medium of each segment of the wall. Hence, typically, but not by way of limitation, where the width of upper partial slot 18*b* is 0.010-inch, the corresponding width of lower partial slot 18*a* could be widened to typically, but not by way of limitation, in the range of 2 to 4 times the width of the corresponding partial upper slot. In some cases the lower partial slot may be up to eight times the width of the width of the corresponding upper partial slot, but, in each case, the benefit of widening the lower partial slot is only seen where, as in the case of this invention, a path is provided for the additional flux to couple with the load. In some examples of the invention, variable lower partial slot widths may be used to further shape flux field penetration into the wall-base interface region, In one non-limiting example of the invention, the protrusions have a height, $h_p$, as shown in FIG. 4(*b*), of 0.38-inch, and a length which is determined by the width of the respective wall segment. The number of protrusions typically matches the number of wall segments which is sufficiently large, so that the protrusions are generally rectangular in elevation cross section. That is outer length $l_{out}$ in FIG. 4(*c*) is not substantially longer than inner length $l_{in}$. Slots 18 have a width of approximately 0.010-inch, and furnace 10 is filled with a metal charge of a weight within the design range specified for the crucible and the electrically conductive alloy or metal, respectively. The equivalent solid volume would generally not be less than that depicted by line 27 (60 percent load line) shown in FIG. 2. Current in induction coil 16 for this non-limiting example of the invention is at 8 kHz. The estimated typical reduction in ohmic losses coupled to base 14 as a percentage of total ohmic losses (i.e., coil+wall+base+molten metal ohmic losses) is graphed in FIG. 5(*a*) for furnaces ranging from no protrusions (0 protrusion width) to a protrusion width, $w_p$. of approximately 0.567-inch. Relative reduction in ohmic losses in slotted wall 12 to ohmic losses in the molten metal is graphed in FIG. 5(*b*) for furnaces ranging from no protrusions to a protrusion width of approximately 0.567-inch. FIG. 5(*c*) illustrates relative reduction in ohmic losses in slotted wall 12 to ohmic losses in the molten metal wherein the slotted wall comprises copper and the magnitude of induction coil current is 7,590 amperes. The gain in overall furnace efficiency for furnaces with the design data in FIG. 5(*a*) and FIG. 5(*b*) is graphed in FIG. 5(*d*) for furnaces ranging from no protrusions to a protrusion width of approximately 0.567-inch. The above graphs were generated by modeling the respective electromagnetic fields using a known three dimensional, finite element analysis, electromagnetic field modeling software.

The foregoing examples do not limit the scope of the disclosed invention. The scope of the disclosed invention is further set forth in the appended claims.

The invention claimed is:

1. A cold crucible induction furnace for heating an electrically conductive load, the cold crucible furnace comprising:

an at least partially slotted furnace wall and a base, the at least partially slotted furnace wall extending below the base;

a plurality of protrusions separating the at least partially slotted furnace wall from the base, the outer rim of the base substantially facing the radially oriented inner surfaces of the plurality of protrusions to form a bottom of an interior crucible volume bounded by the interior of the furnace wall, an exposed upper surface of each of the plurality of protrusions and of the base facing the interior crucible volume;

at least one induction coil at least partially surrounding the height of the furnace wall; and an ac power source having its output connected to the at least one induction coil to supply ac power to the at least one induction coil and generate an ac field around the at least one induction coil, the ac field magnetically coupling with the electrically conductive load to inductively heat the electrically conductive material by induced eddy currents in the electrically conductive material.

2. The cold crucible induction furnace of claim 1 wherein each of the plurality of protrusions has a width approximately equal to one depth of current penetration into the electrically conductive load.

3. The cold crucible induction furnace of claim 1 wherein at least one of the plurality of protrusions has at least one protrusion slot.

4. The cold crucible induction furnace of claim 1 where the base has at least one base slot around the outer perimeter of the base.

5. The cold crucible induction furnace of claim 1 wherein at least one of the plurality of protrusions is generally rectangular in shape.

6. The cold crucible induction furnace of claim 1 further comprising a base support structure to hold the base in position without support of the base by the plurality of protrusions.

7. A cold crucible induction furnace for heating an electrically conductive load, the cold crucible furnace comprising:

an at least partially slotted furnace wall and a base, the at least partially slotted furnace wall extending below the base;

a plurality of protrusions separating the at least partially slotted furnace wall from the base, the outer rim of the base substantially facing the radially oriented inner surfaces of the plurality of protrusions to form a bottom of an interior crucible volume bounded by the interior of the furnace wall, an exposed upper surface of each of the plurality of protrusions and of the base facing the interior crucible volume;

a gap between each of the radially oriented inner surfaces of the plurality of protrusions and the outer rim of the base;

at least one induction coil at least partially surrounding the height of the furnace wall; and an ac power source having its output connected to the at least one induction coil to supply ac power to the at least one induction coil and generate an ac field around the at least one induction coil, the ac field magnetically coupling with the electrically conductive load to inductively heat the electrically conductive material by induced eddy currents in the electrically conductive material.

8. The cold crucible induction furnace of claim 7 wherein the gap is filled with an electrical insulating material.

9. The cold crucible induction furnace of claim 7 wherein each of the plurality of protrusions has a width approximately equal to one depth of current penetration into the electrically conductive load.

10. The cold crucible induction furnace of claim 7 wherein at least one of the plurality of protrusions has at least one protrusion slot.

11. The cold crucible induction furnace of claim 7 where the base has at least one base slot around the outer perimeter of the base.

12. The cold crucible induction furnace of claim 7 wherein at least one of the plurality of protrusions is generally rectangular in shape.

13. The cold crucible induction furnace of claim 7 further comprising a base support structure to hold the base in position without support of the base by the plurality of protrusions.

14. A method of inductively heating an electrically conductive load, the method comprising the steps of:

forming an interior crucible volume from an at least partially slotted furnace wall and a bottom formed from a plurality of protrusions and a base having a continuous surface facing the interior crucible volume, each of the plurality of protrusions extending into the interior of the furnace wall and having an exposed upper surface facing the interior crucible volume, the outer rim of the base substantially facing the radially oriented inner surfaces of the plurality of protrusions, the at least partially slotted furnace wall extending below the bottom of the interior crucible volume;

placing the electrically conductive load in the interior crucible volume;

at least partially surrounding the interior crucible volume with an at least one induction coil; and supplying ac power to the at least one induction coil to generate a magnetic field for coupling with the electrically conductive load in the interior crucible volume.

15. The method of claim 14 further comprising the step of forming a gap between at least one of the radially oriented inner surfaces of the plurality of protrusions and the outer rim of the base.

16. The method of claim 14 further comprising the step of forming at least one protrusion slot in at least one of the plurality of protrusions.

17. The method of claim 14 further comprising the step of forming at least one base slot around the outer perimeter of the base.

18. A method of inductively heating an electrically conductive load, the method comprising the steps of placing the electrically conductive load in an interior crucible volume formed from an at least partially slotted furnace wall and a bottom formed from a plurality of protrusions and a base, each of the plurality of protrusions extending into the interior of the furnace wall and having an exposed upper surface facing the interior crucible volume, the outer rim of the base substantially facing the radially oriented inner surfaces of the plurality of protrusions, the at least partially slotted furnace wall extending below the bottom of the interior crucible volume; at least partially surrounding the crucible volume by an at least one induction coil; and applying ac power to the at least one induction coil to generate a magnetic field that couples with the electrically conductive load.

19. A cold crucible induction furnace for heating an electrically conductive load, the cold crucible furnace comprising:

an at least partially slotted furnace wall having a plurality of slots and a base to form a crucible volume in which the electrically conductive load is contained, the plurality of slots in the at least partially slotted furnace wall wider below the base than the width of the plurality of slots above the base;

a plurality of protrusions separating the at least partially slotted furnace wall from the base, the rim of the base substantially facing the inner surfaces of the plurality of protrusions;

at least one induction coil at least partially surrounding the height of the furnace wall; and an ac power source having its output connected to the at least one induction coil to supply ac power to the at least one induction coil and generate an ac field around the at least one induction coil, the ac field magnetically coupling with the electrically conductive load to inductively heat the electrically conductive material by induced eddy currents in the electrically conductive material.

20. The apparatus of claim 19 further comprising a gap between each of the inner surfaces of the plurality of protrusions and the rim of the base.

21. The apparatus of claim 20 wherein the gap is filled with an electrical insulating material.

22. A method of inductively heating an electrically conductive load, the method comprising the steps of:

forming a crucible volume from an at least partially slotted furnace wall having a plurality of slots and a base;

widening at least one of the one of the plurality of slots in the at least partially slotted furnace wall below the base;

separating the rim of the base from the at least partially slotted furnace wall by a plurality of protrusions by facing the rim of the base opposite the inner surfaces of the plurality of protrusions;

placing the electrically conductive load in the crucible volume;

at least partially surrounding the crucible volume with an at least one induction coil; and supplying ac power to the at least one induction coil to generate a magnetic field for coupling with the electrically conductive load in the crucible volume.

* * * * *